US009444157B2

(12) United States Patent
Kim et al.

(10) Patent No.: US 9,444,157 B2
(45) Date of Patent: Sep. 13, 2016

(54) CONNECTOR AND REFRIGERATOR INCLUDING THE SAME

(71) Applicant: SAMSUNG ELECTRONICS CO., LTD., Suwon-si (KR)

(72) Inventors: Sung Il Kim, Yongin-si (KR); Han Joo Yoo, Suwon-si (KR); Si Ho Jang, Yongin-si (KR); Jae Hoon Lim, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 18 days.

(21) Appl. No.: 14/493,657

(22) Filed: Sep. 23, 2014

(65) Prior Publication Data

US 2015/0194749 A1 Jul. 9, 2015

(30) Foreign Application Priority Data

Jan. 6, 2014 (KR) ..... 10-2014-0001247

(51) Int. Cl.

| | |
|---|---|
| ***H01R 9/16*** | (2006.01) |
| ***H01R 12/81*** | (2011.01) |
| ***F25D 23/00*** | (2006.01) |
| ***H01R 13/506*** | (2006.01) |
| *H01R 13/514* | (2006.01) |
| *H01R 13/74* | (2006.01) |

(52) U.S. Cl.

CPC ..... *H01R 9/16* (2013.01); *F25D 23/00* (2013.01); *H01R 12/81* (2013.01); *H01R 13/506* (2013.01); *F25D 2400/40* (2013.01); *H01R 13/514* (2013.01); *H01R 13/74* (2013.01)

(58) Field of Classification Search

CPC ... H01R 12/78; H01R 13/639; H01R 4/5066
See application file for complete search history.

(56) References Cited

U.S. PATENT DOCUMENTS

| | | | | |
|---|---|---|---|---|
| 4,898,549 A * | 2/1990 | Nakama | H01R 13/506 | 439/701 |
| 5,266,043 A * | 11/1993 | Giroux | H01R 31/08 | 439/188 |
| 5,885,107 A * | 3/1999 | Sluss | H01R 13/4223 | 439/595 |
| 6,146,190 A * | 11/2000 | Fuerst | H01R 12/81 | 439/496 |
| 6,361,374 B1 * | 3/2002 | Lloyd | H01R 13/518 | 439/607.12 |

(Continued)

FOREIGN PATENT DOCUMENTS

| | | |
|---|---|---|
| KR | 20130064837 A | 6/2013 |
| KR | 101337218 B1 | 12/2013 |

OTHER PUBLICATIONS

European Search Report dated Apr. 30, 2015 in corresponding European Patent Application 14188848.7.

*Primary Examiner* — Truc Nguyen
(74) *Attorney, Agent, or Firm* — Staas & Halsey LLP

(57) ABSTRACT

A refrigerator having an inner case that constitutes a storage compartment, an outer case that is coupled to an outer side of the inner case and constitutes an exterior, and a connector that connects a flexible flat cable (FFC) and wires. The connector includes a first housing having an accommodation space in which the FFC is inserted, a plurality of second housings in which a wire insertion hole into which the wires are inserted, is formed and which are coupled to the first housing, and connection members provided in the first housing and the plurality of second housings so as to electrically connect the FFC and the wires. The connector is installed at the inner case in such a way that the first housing faces the outer case and the second housings face the storage compartment.

20 Claims, 16 Drawing Sheets

(56) References Cited

U.S. PATENT DOCUMENTS 6,780,069 B2 * 8/2004 Scherer ..... H01R 13/514 439/595
8,579,654 B2 * 11/2013 Chen ..... H01R 12/61 439/267
2003/0194899 A1 * 10/2003 Ueda ..... H01R 13/6272 439/357
2004/0175982 A1 * 9/2004 Kuroda ..... H01R 13/6275 439/358
2005/0148240 A1 * 7/2005 Kim ..... H01R 13/6597 439/95
2007/0093102 A1 4/2007 Park et al.
2008/0026612 A1 * 1/2008 Malstrom ..... H01R 13/65807 439/79
2009/0121598 A1 5/2009 Kang
2010/0120280 A1 5/2010 Shen et al.
2012/0184127 A1 * 7/2012 Hanyu ..... H01R 13/6273 439/370
2013/0137285 A1 5/2013 Miura et al.

* cited by examiner

CONNECTOR AND REFRIGERATOR INCLUDING THE SAME

CROSS-REFERENCE TO RELATED APPLICATIONS

This application claims the benefit of Korean Patent Application No. 10-2014-0001247, filed on Jan. 6, 2014 in the Korean Intellectual Property Office, the disclosure of which is incorporated herein by reference.

BACKGROUND

1. Field

Embodiments of the present disclosure relate to a connector and a refrigerator including the same, and more particularly, to a connector having an improved structure in which energy can be reduced and a plurality of wires connected to an electronic component can be arranged, and a refrigerator including the connector.

2. Description of the Related Art

In general, a refrigerator is an apparatus that keeps food fresh by including a body that constitutes an exterior, a storage compartment provided in the body so that a front side of the storage compartment is opened, and a cold air supplying unit for supplying cold air to the storage compartment.

The open front side of the storage compartment of the refrigerator is closed by a door so that temperature of the storage compartment can be kept at normal times.

The body includes an inner case that constitutes the storage compartment and an outer case that constitutes the exterior. An insulating material is foamed between the inner case and the outer case so as to prevent outflow of cold air of the storage compartment.

A wire harness that is an assembly of wires connected to a printed circuit board (PCB) before the insulating material is foamed, is inserted into a space in which the insulating material between the inner case and the outer case is foamed.

A connector is used to supply electricity to the refrigerator, i.e., to electrically connect the wire harness to various electronic components provided at the refrigerator.

A board-to-wire type connector that is mainly used includes a header mounted on the PCB and a housing to which a cable is coupled. A process of coupling the cable to the housing is mainly performed manually. Since the connector is configured with a plurality of components and is assembled manually, cost of the connector itself is very high, and price competitiveness is low.

SUMMARY

Therefore, it is an aspect of the present disclosure to provide a connector having an improved structure in which an insulating material is uniformly foamed between an inner case and an outer case so that energy efficiency can be improved, and a refrigerator including the connector.

It is another aspect of the present disclosure to provide a connector having a structure in which the volume of a wire harness inserted between an inner case and an outer case is reduced so that an accommodation capability of a storage compartment is improved, and a refrigerator including the connector.

Additional aspects of the disclosure will be set forth in part in the description which follows and, in part, will be obvious from the description, or may be learned by practice of the disclosure.

In accordance with one aspect of the present disclosure, a refrigerator includes: an inner case that constitutes a storage compartment; an outer case that is coupled to an outer side of the inner case and constitutes an exterior; and a connector that connects a flexible flat cable (FFC) and wires, wherein the connector includes: a first housing in which an accommodation space in which the FFC is inserted, is formed; a plurality of second housings in which a wire insertion hole into which the wires are inserted, is formed and which are coupled to the first housing; and connection members provided in the first housing and the plurality of second housings so as to electrically connect the FFC and the wires, and wherein the connector is installed at the inner case in such a way that the first housing faces the outer case and the second housings face the storage compartment.

A foaming space in which an insulating material is filled, may be provided between the outer case and the inner case, and the FFC may closely contact an outer surface of the inner case so that the insulating material can be uniformly filled in the foaming space.

The first housing may include: a body that constitutes an exterior of the first housing; a base that extends from the body in a first direction and has a plurality of slits formed therein; and a cover that constitutes the accommodation space together with the base and is rotatably coupled to the body.

Each of the connection members may include a first terminal provided in the body, and a cable connecting portion may be formed at one end of the first terminal, may be coupled to the plurality of slits, and may be electrically connected to the FFC in the accommodation space.

A cover holder may be formed at one end of the first terminal so as to be spaced apart from the cable connecting portion by a predetermined gap, and insertion holes may be formed in the cover in a length direction of the cover so as to correspond to the cover holder.

If the cover is rotated so that the FFC is inserted into the accommodation space, the cover holder may be coupled to the insertion holes and may face the cable connecting portion.

A housing fastening hole that is opened in a second direction may be formed in the body, and each of the second housings may include a casing that is coupled to the housing fastening hole and has the wire insertion hole provided in the casing.

The other end of the first terminal may extend from one end of the first terminal in the second direction so that the first terminal can be accommodated in the housing fastening hole.

Each of the connection members may further include a second terminal accommodated in the wire insertion hole, and the second terminal in the wire insertion hole may be electrically connected to the other end of the first terminal that passes through the casing.

The second terminal may include: a wire fastening portion that is accommodated in the wire insertion hole so as to be in the second direction and electrically connected to the wires coupled to the wire insertion hole; and a terminal coupling portion that extends from the wire fastening portion in the first direction so that the other end of the first terminal can be coupled to the terminal coupling portion, and a plurality of fixing pieces may be provided at the terminal coupling portion and may face an inner side of the terminal coupling portion so as to closely contact an outer circumferential surface of the other end of the first terminal.

The connector may further include a binder that is coupled to the second housings in the first direction, and the binder may include: an insertion portion that is coupled to the wire insertion hole; and a support portion that is spaced apart from the insertion portion by a predetermined gap in a vertical direction and supports an outer circumferential surface of each of the second housings if the insertion portion is coupled to the wire insertion hole.

The insertion portion in the wire insertion hole may support the wire fastening portion.

A hanging jaw that protrudes toward an outer side of the body may be formed on an outer circumferential surface of the body corresponding to the housing fastening hole, and each of the second housings may further include a holder unit that is coupled to the hanging jaw so as to reinforce a coupling force of the casing with respect to the housing fastening hole.

The holder unit may be coupled to the casing, and a protrusion portion may be formed at one end of the holder unit in the first direction and may be fastened to the hanging jaw.

In accordance with another aspect of the present disclosure, a connector includes: a first housing in which an accommodation space in which a flexible flat cable (FFC) is inserted, is formed; a plurality of second housings in which a wire insertion hole in which wires are inserted, is formed and which are coupled to the first housing; connection members provided in the first housing and the plurality of second housings so as to electrically connect the FFC and the wires; and a binder that is coupled to the wire insertion hole formed in each of the plurality of second housings so as to prevent the plurality of second housings coupled to each other from being separated from each other.

The plurality of second housings may be laterally coupled to each other, and a protrusion rib may be formed at a side of one of the plurality of second housings and may protrude toward an outer side of one of the plurality of second housings, and a rib accommodation portion may be formed at a side of the other one of the plurality of second housings so as to be coupled to the protrusion rib and to be recessed into an inner side of the other one of the plurality of second housings.

Each of the connection members may include: a first terminal provided in the body that constitutes an exterior of the first housing; and a second terminal that is provided in a casing that constitutes an exterior of the second housings and electrically connected to the first terminal, and the first terminal and the second terminal may be formed of a material through which a current flows.

The first terminal may include: a cable connecting portion that protrudes in a first direction and is electrically connected to the FFC in the accommodation space; and a terminal connecting portion that extends from the cable connecting portion so as to be in a second direction that is opposite to the first direction.

The second terminal may include: a wire fastening portion that is accommodated in the wire insertion hole and electrically connected to the wires coupled to the wire insertion hole; and a terminal coupling portion that extends from the wire fastening portion so as to be electrically connected to the terminal connecting portion that passes through the second housings in the wire insertion hole.

In accordance with still another aspect of the present disclosure, A connector comprising: a first housing comprising an accommodation space to insert a flexible flat cable (FFC); a plurality of second housings comprising wire insertion holes and to couple to the first housing; and a binder coupled to the wire insertion holes to prevent the plurality of second housings from being separated from each other.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
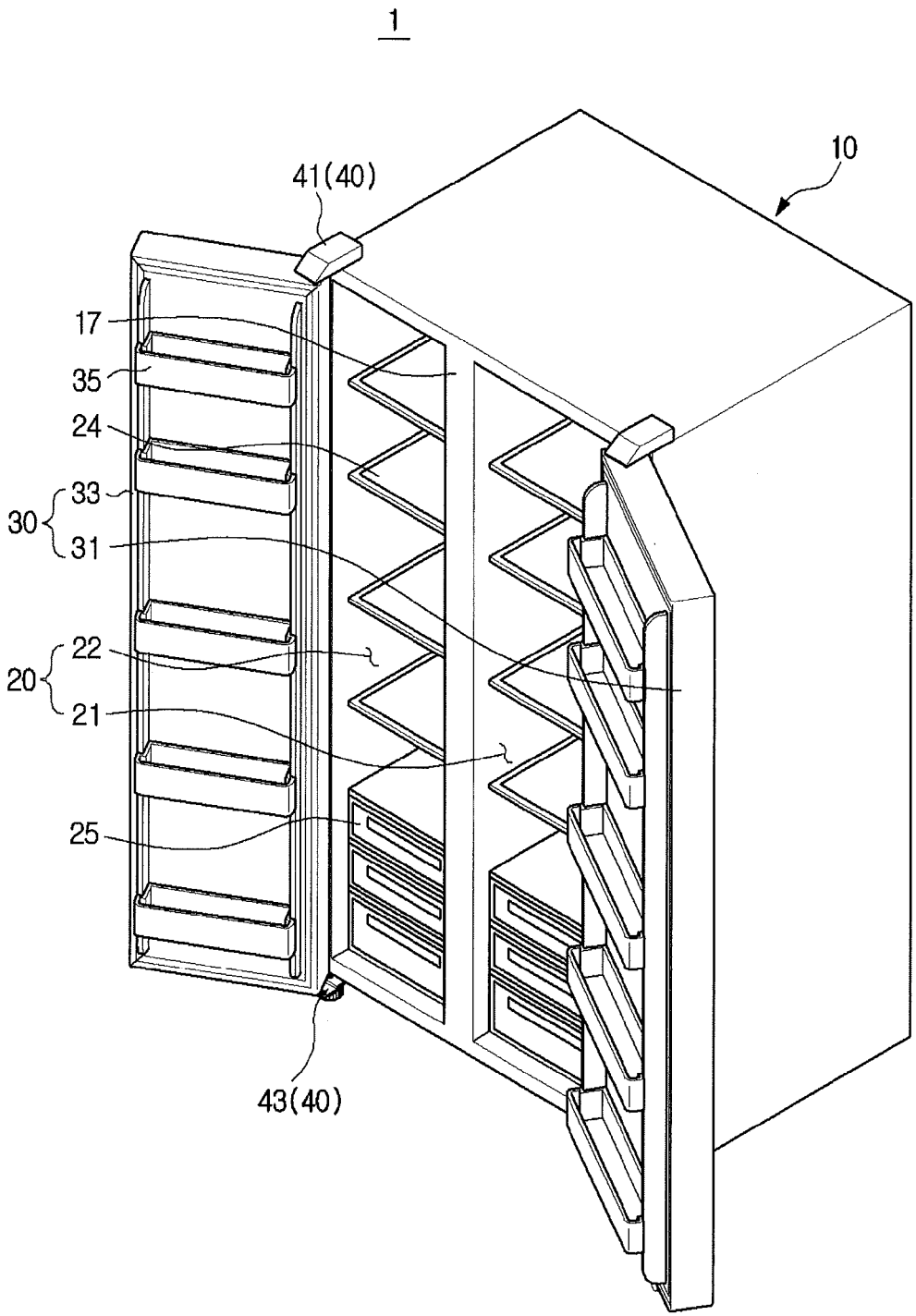
FIG. 1 is a perspective view illustrating an exterior of a refrigerator in accordance with an embodiment of the present disclosure.

Reference will now be made in detail to the embodiments of the present disclosure, examples of which are illustrated in the accompanying drawings, wherein like reference numerals refer to like elements throughout. The terms used herein, such as a "front end," a "rear end," an "upper portion," a "lower portion," a "top end," and a "bottom end," are defined based on the drawings, and the shape and position of each element are not limited by the terms. A wire harness is a bundle of wires.

Figure 2:
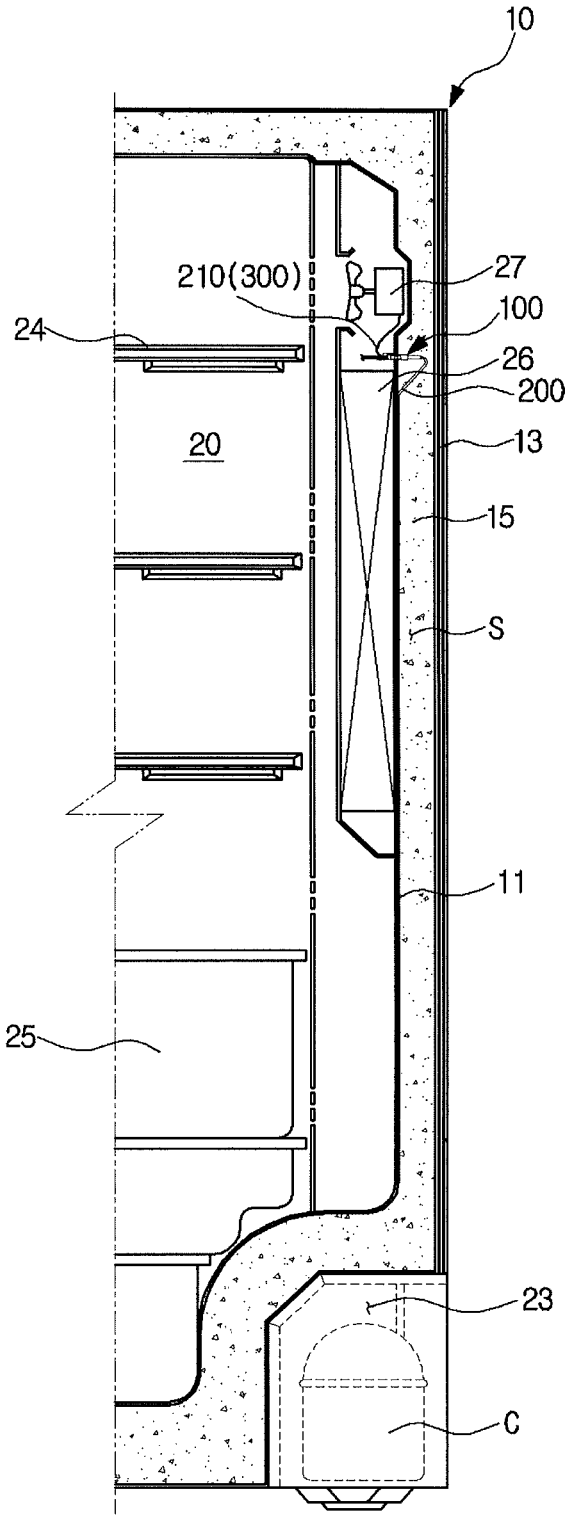
FIG. 2 is a cross-sectional view illustrating a partial configuration of the refrigerator illustrated in FIG. 1.
Figure 3:
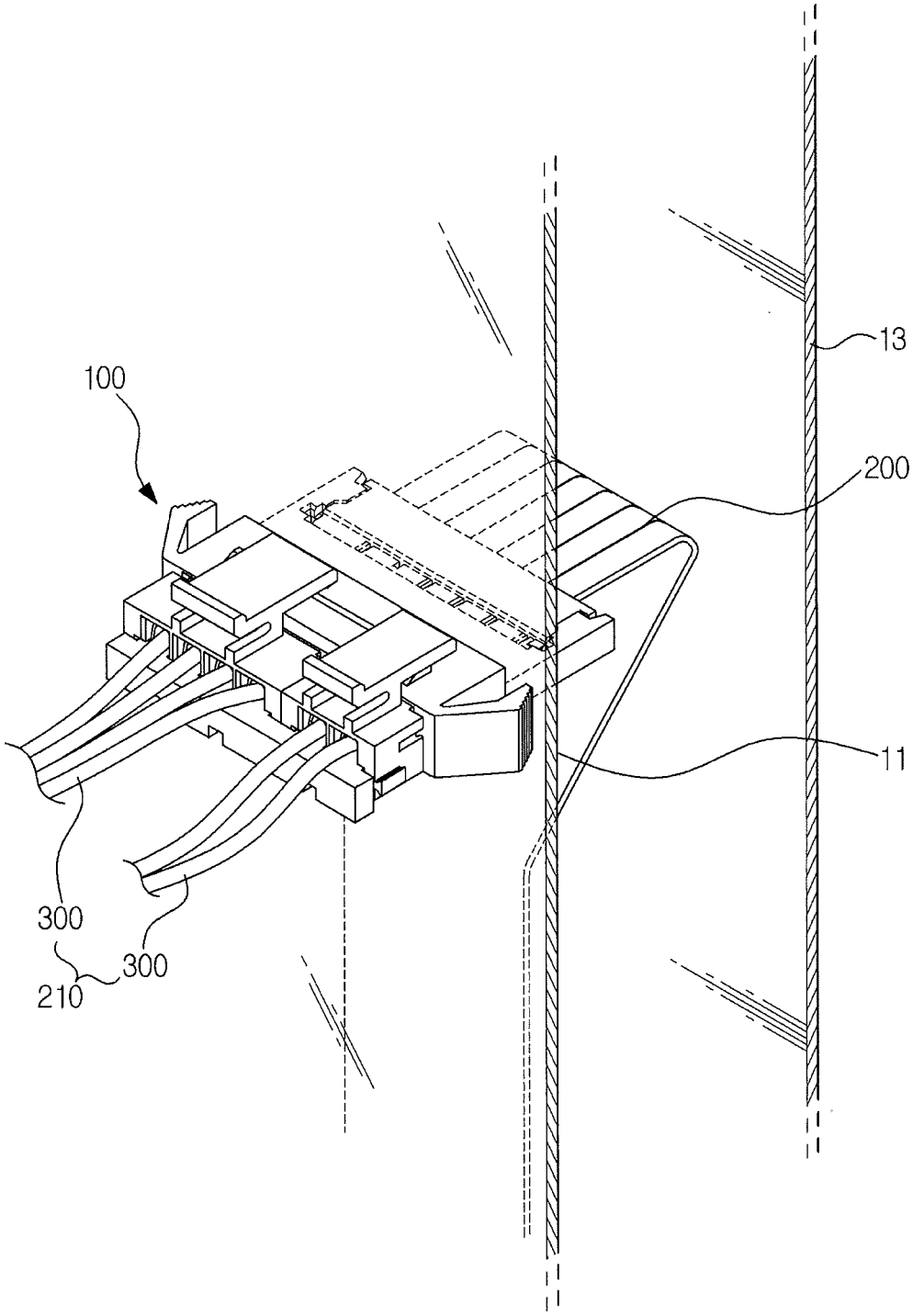
FIG. 3 is an enlarged perspective view illustrating a state in which a connector is installed at the refrigerator of FIG. 1.

FIG. 1 is a perspective view illustrating an exterior of a refrigerator in accordance with an embodiment of the present disclosure, and FIG. 2 is a cross-sectional view illustrating a partial configuration of the refrigerator illustrated in FIG. 1, and FIG. 3 is an enlarged perspective view illustrating a state in which a connector is installed at the refrigerator of FIG. 1.

As illustrated in FIGS. 1 through 3, a refrigerator 1 includes a body 10 that constitutes an exterior, a storage compartment 20 provided in the body 10 so that a front side of the storage compartment 20 is opened, a door 30 that opens/closes the storage compartment 20, and a hinge module 40 including an upper hinge 41 and a lower hinge 43 that cause the door 30 to be rotatably coupled to the body 10.

The body 10 includes an inner case 11 that constitutes the storage compartment 20, an outer case 13 that constitutes the exterior, and a cold air supplying unit that supplies cold air to the storage compartment 20.

The cold air supplying unit may include a compressor C, a condenser (not shown), an expansion valve (not shown), an evaporator 26, and a blower fan 27. An insulating material 15 is foamed between the inner case 11 and the outer case 13 of the body 10 so as to prevent outflow of cold air of the storage compartment 20.

A machine compartment 23 in which the compressor C for compressing a refrigerant and the condenser for condensing the compressed refrigerant are installed, is provided at a lower side of the rear of the body 10.

The storage compartment 20 is partitioned off into a right refrigerator compartment 21 disposed at the right side of the body 10 and a left freezer compartment 22 disposed at the left side of the body 10 by a barrier wall 17.

The refrigerator compartment 21 and the freezer compartment 22 are opened/closed by a refrigerator compartment door 31 and a freezer compartment door 33, respectively, which are rotatably coupled to the body 10. A plurality of door guards 35 are provided at rear sides of the refrigerator compartment door 31 and the freezer compartment door 33 so as to accommodate food.

A plurality of shelves 24 may be provided in the storage compartment 20 and may partition off the storage compartment 20 into a plurality of portions. An article, such as food, is stacked on the plurality of shelves 24.

Also, a plurality of storage boxes 25 are provided in the storage compartment 20 to be inserted into or taken out from the storage compartment 20 in a sliding manner.

A foaming space S is provided between the inner case 11 that constitutes the storage compartment 20 and the outer case 13 that is coupled to an outer surface of the inner case 11 and constitutes the exterior, and the insulating material 15 is filled in the foaming space S.

A connector 100 that electrically connects a flexible flat cable (FFC) 200 connected to a printed circuit board (PCB) (not shown) provided at a rear side of the body 10 to a wire harness 210 that is an assembly of wires 300 connected to an electronic component, such as a sensor or a switch, is inserted in the foaming space S before the insulating material 15 is filled in the foaming space S.

The connector 100 may be placed between the outer case 13 and the inner case 11 and may be installed at the inner case 11, in detail.

Also, the connector 100 may be installed at the inner case 11 in such a way that a first housing (see 110 of FIG. 4) faces the outer case 13 and a plurality of second housings (see 120 of FIG. 4) face the storage compartment 20.

The connector 100 may be installed at the inner case 11 so as to pass through the inner case 11. In detail, a connector coupling portion (not shown) to which the connector 100 can be coupled, may be formed at the inner case 11. The connector 100 may be coupled to the connector coupling portion (not shown) in such a way that the first housing (see 110 of FIG. 4) faces the outer case 13 and the second housings (see 120 of FIG. 4) face the storage compartment 20.

After the connector 100 is inserted into the foaming space S, the insulating material 15 is filled in the foaming space S. In detail, the connector 100 may be coupled to the connector coupling portion (not shown) formed at the inner case 11, and the insulating material 15 is filled in the foaming space S after the FFC 200 is coupled to the first housing (see 110 of FIG. 4) and closely contacts and is fixed to the outer surface of the inner case 11.

In order to reinforce an insulating property of the insulating material 15, a vacuum insulation panel (VIP)(not shown) may be filled in the foaming space S together with the insulating material 15.

As described above, the FFC 200 may closely contact or may be fixed to the outer surface of the inner case 11 so that the insulating material 15 can be uniformly filled in the foaming space S.

When the connector 100 connects the FFC 200 and the wires 300, one of the FFC 200 and the wires 300 may pass through the hinge module 40 and may be connected to the connector 100.

Figure 4:
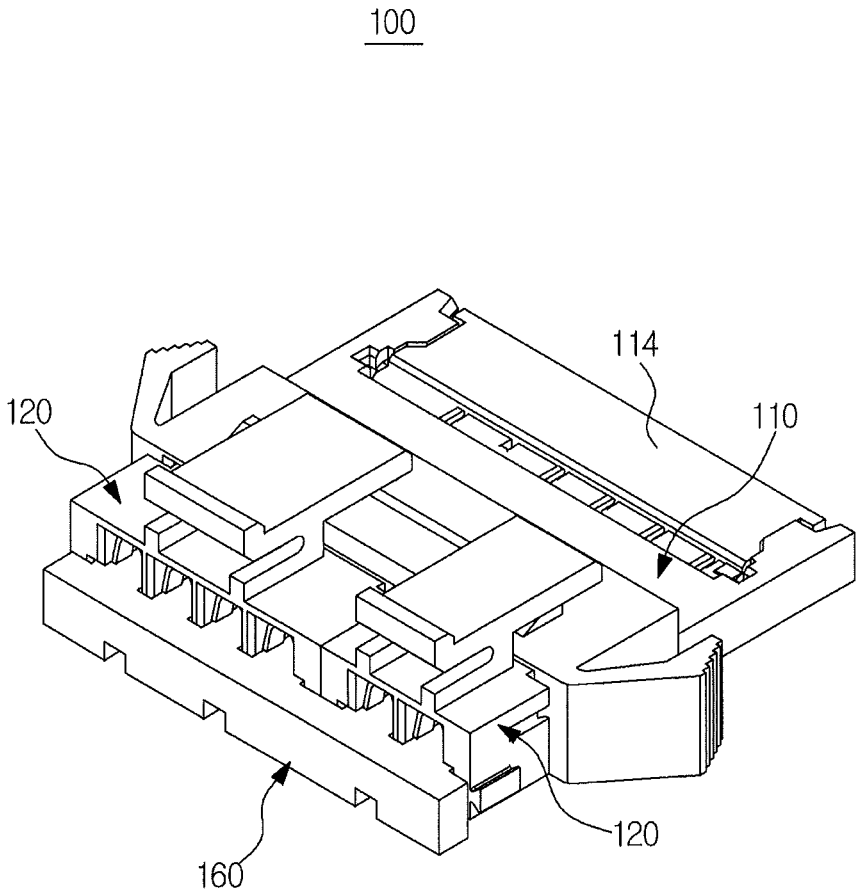
FIG. 4 is a perspective view illustrating the connector installed at the refrigerator of FIG. 1.
Figure 5:
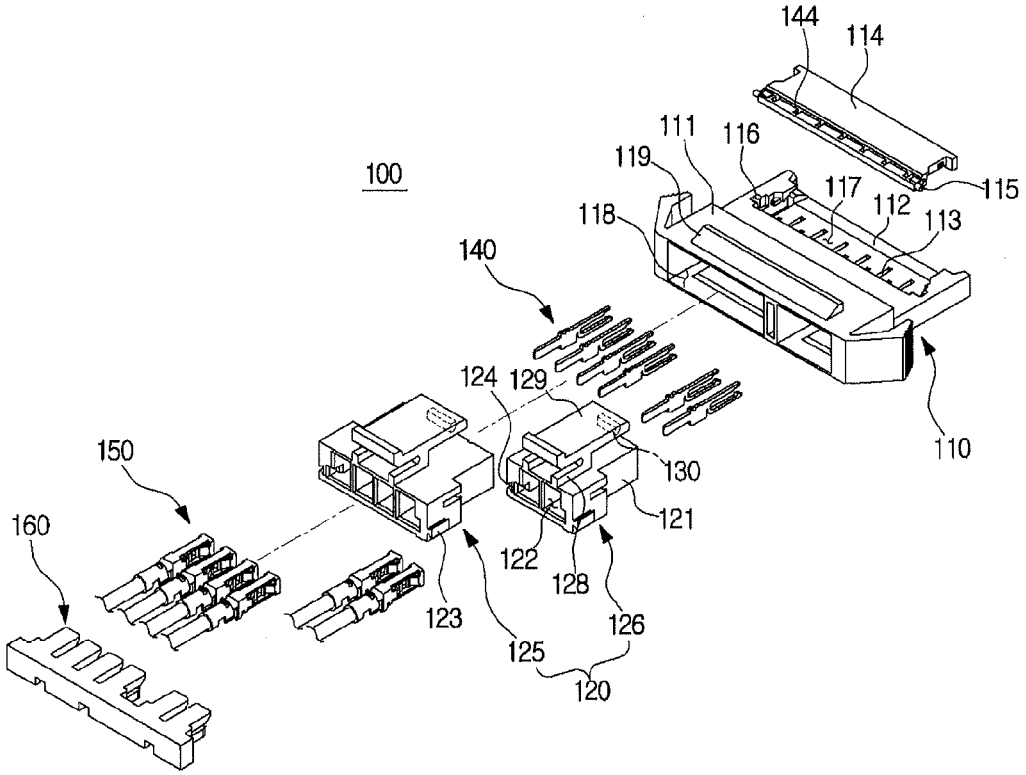
FIG. 5 is an exploded perspective view illustrating the connector of FIG. 4.
Figure 6:
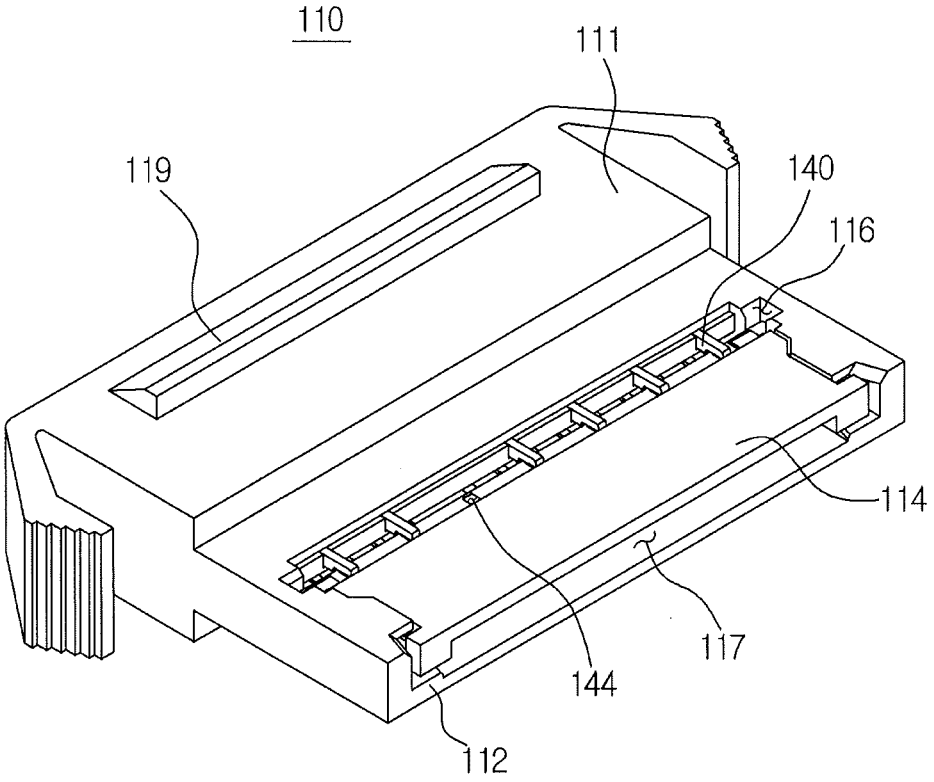
FIG. 6 is a perspective view illustrating a first housing that constitutes the connector of FIG. 4.
Figure 7:
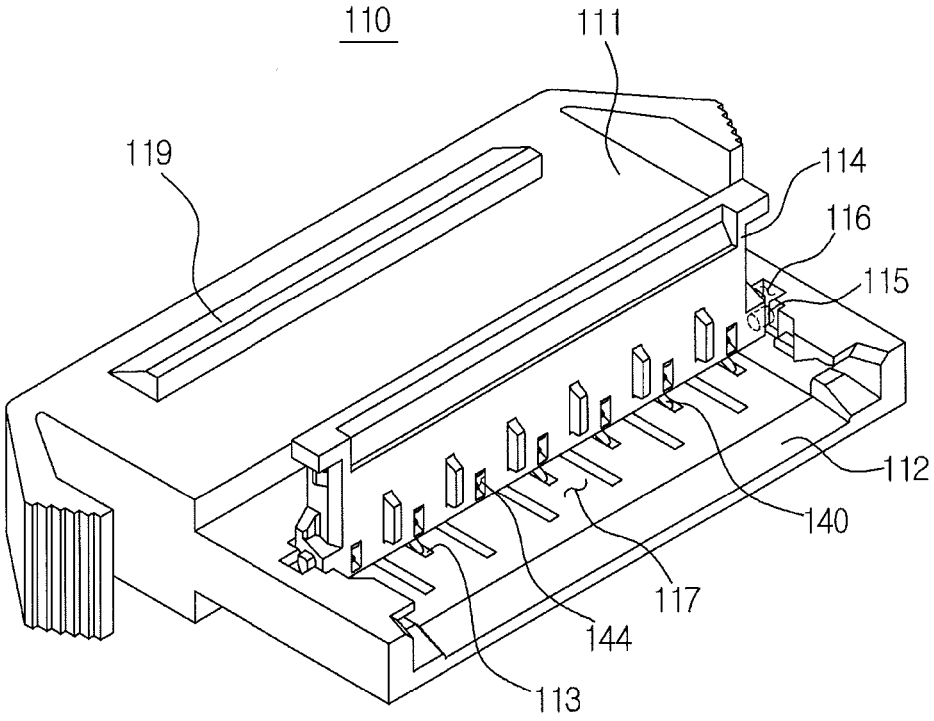
FIG. 7 is a perspective view illustrating a state in which a cover of the first housing of FIG. 6 is opened.
Figure 8:
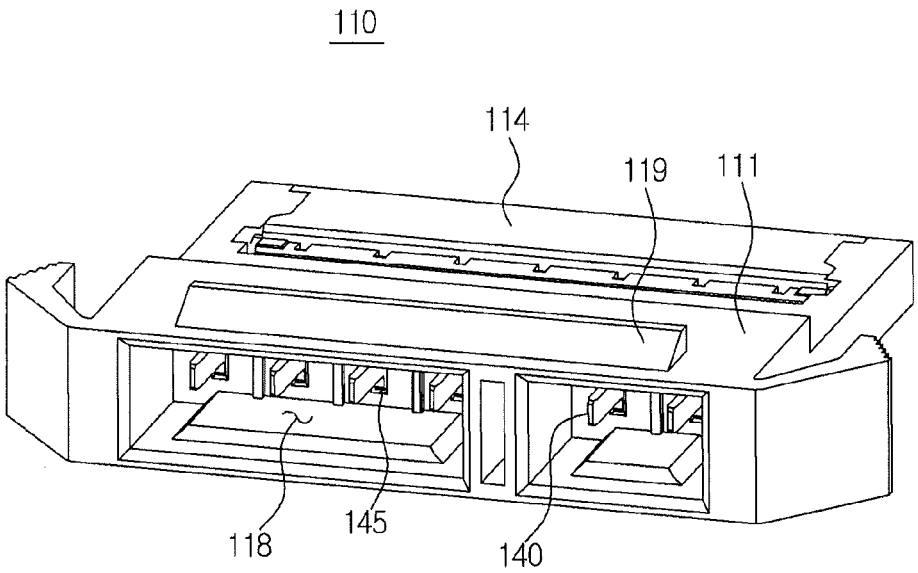
FIG. 8 is a perspective view illustrating the first housing of FIG. 6 from another side.
Figure 9:
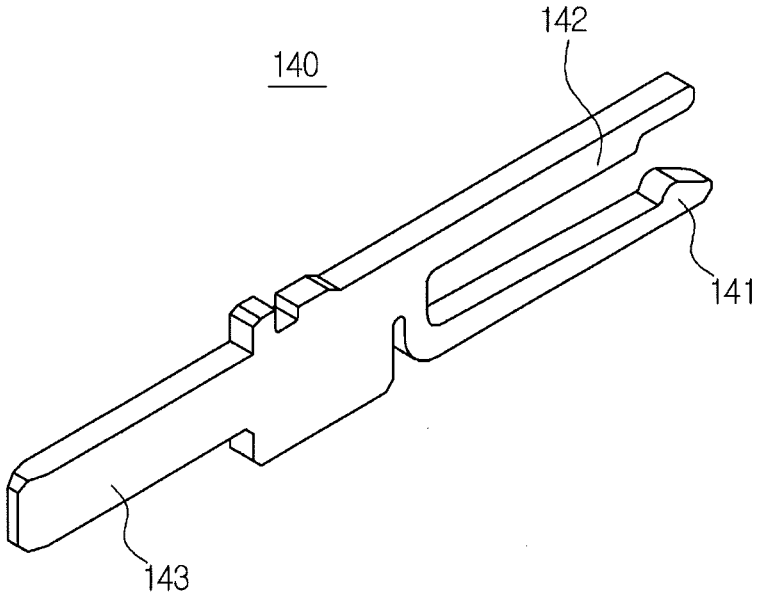
FIG. 9 is a perspective view illustrating a first terminal that constitutes the connector of FIG. 4.
Figure 10:
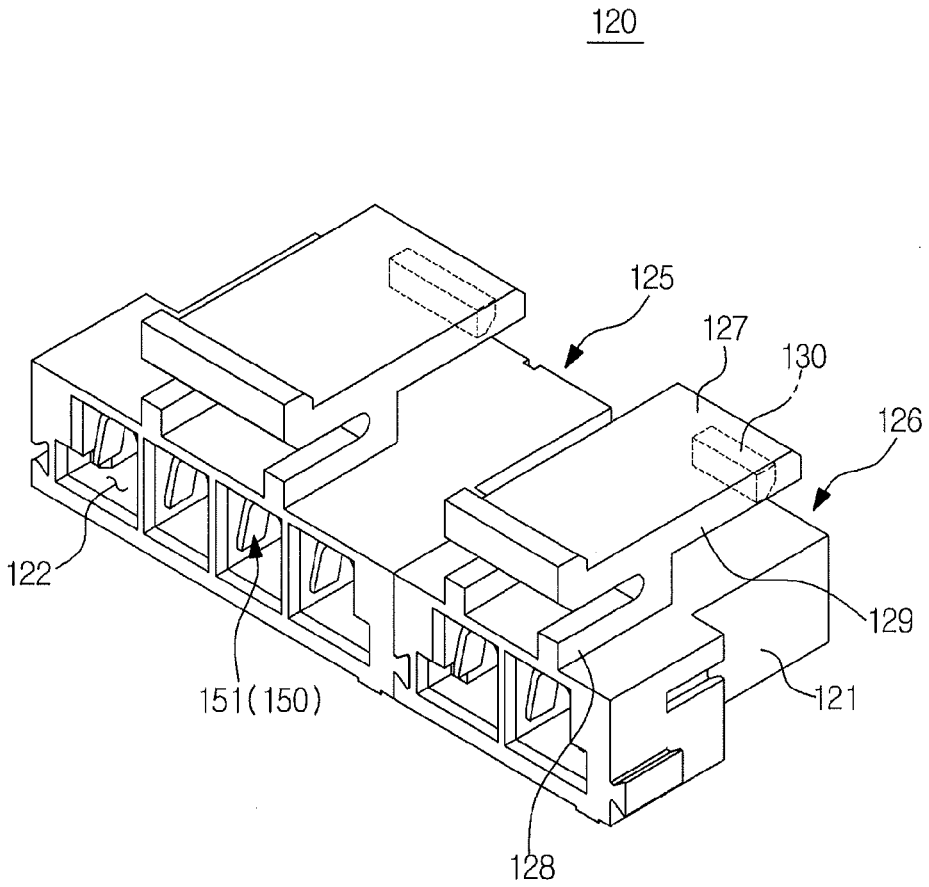
FIG. 10 is a perspective view illustrating a plurality of second housings that constitute the connector of FIG. 4.
Figure 11:
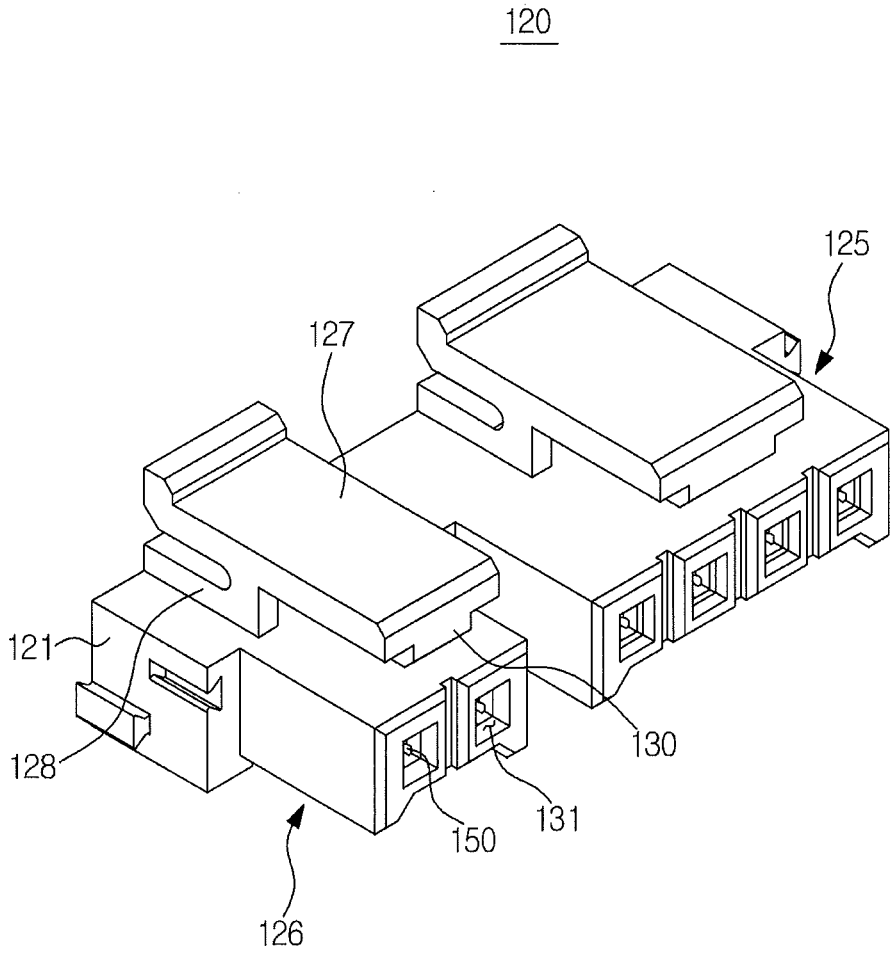
FIG. 11 is a perspective view illustrating the plurality of second housings of FIG. 10 from another side.
Figure 12:
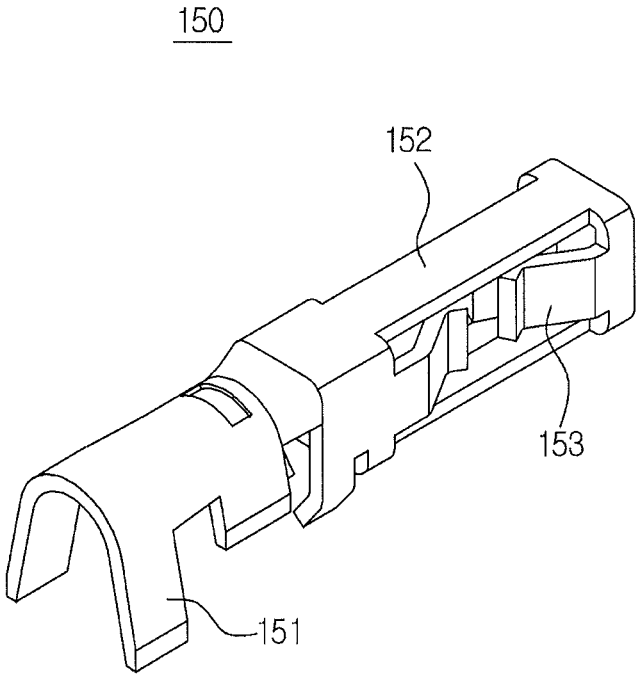
FIG. 12 is a perspective view illustrating a second terminal that constitutes the connector of FIG. 4.
Figure 13:
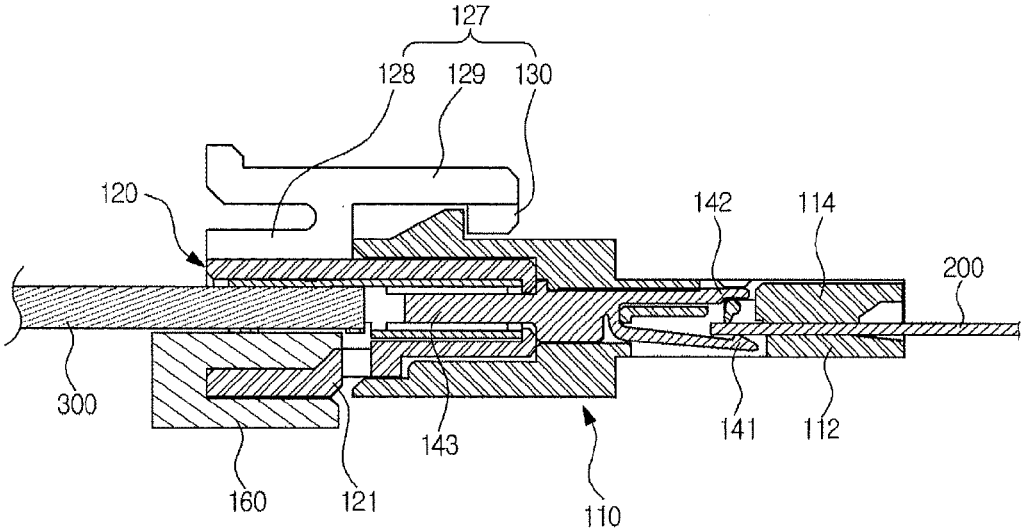
FIG. 13 is a cross-sectional view illustrating a configuration of the connector of FIG. 4.

FIG. 4 is a perspective view illustrating the connector installed at the refrigerator of FIG. 1, and FIG. 5 is an exploded perspective view illustrating the connector of FIG. 4, and FIG. 6 is a perspective view illustrating a first housing that constitutes the connector of FIG. 4, and FIG. 7 is a perspective view illustrating a state in which a cover of the first housing of FIG. 6 is opened, and FIG. 8 is a perspective view illustrating the first housing of FIG. 6 from another side, and FIG. 9 is a perspective view illustrating a first terminal that constitutes the connector of FIG. 4, and FIG. 10 is a perspective view illustrating a second housing that constitutes the connector of FIG. 4, and FIG. 11 is a perspective view illustrating the second housing of FIG. 10 from another side, and FIG. 12 is a perspective view illustrating a second terminal that constitutes the connector of FIG. 4, and FIG. 13 is a cross-sectional view illustrating a configuration of the connector of FIG. 4. Unexplained reference numerals refer to FIGS. 1 through 3.

As illustrated in FIGS. 4 through 13, the connector 100 may include a first housing 110, at least one of a plurality of second housings 120, and connection members 140 and 150.

The first housing 110 may include a body 111, a base 112, and a cover 114.

The body 111 constitutes an exterior of the first housing 110, and the base 112 and the cover 114 constitute an accommodation space 117 in which the FFC 200 is inserted. The base 112 extends from the body 111 in a first direction A, and the cover 114 is rotatably coupled to the body 111 so as to face the base 112. In detail, a rotation shaft 115 may be formed on the cover 114 in a length direction of the cover 114. The rotation shaft 115 may be coupled to a shaft coupling hole 116 formed in an inner wall of the accommodation space 117 so as to be recessed toward an outer side of the accommodation space 117, and the cover 114 may be rotated around the rotation shaft 115. The accommodation space 117 may be opened/closed as the cover 114 is rotated around the rotation shaft 115.

A plurality of slits 113 may be formed in the base 112. Part of the first terminal 140 accommodated in the body 111 may be exposed to an inner side of the accommodation space 117 through the plurality of slits 113 so as to be electrically connected to the FFC 200 inserted into the accommodation space 117.

A housing fastening hole 118 may be formed in the body 111 and may be opened in a second direction B. A hanging jaw 119 that protrudes toward an outer side of the body 111 may be formed on an outer circumferential surface of the body 111 corresponding to the housing fastening hole 118. The hanging jaw 119 may be formed in a length direction of the body 111.

An inner case coupling portion (not shown) may be formed at the first housing 110. The inner case coupling portion (not shown) may be coupled to the body 111 and may partition the first housing 110 into a portion in which the hanging jaw 119 is formed, and a portion in which the accommodation space 117 is formed.

The connector 100 may be fixed to the inner case 11 by the inner case coupling portion (not shown).

One surface of the inner case coupling portion (not shown) may be fixed to an inner surface of the inner case 11.

Alternatively, one surface of the inner case coupling portion (not shown) may be fixed to the outer surface of the inner case 11.

Alternatively, the inner case coupling portion (not shown) may be coupled to the connector coupling portion (not shown) formed at the inner case 11.

At least one of the plurality of second housings 120 may include a casing 121 and a holder unit 127. The casing 121 and the holder unit 127 may be placed in a vertical direction. The holder unit 127 may be placed at an upper portion of the casing 121 so as to correspond to the hanging jaw 119 of the body 111. However, embodiments of the present disclosure are not limited thereto.

The casing 121 that constitutes an exterior of the plurality of second housings 120 is coupled to the housing fastening hole 118 formed in the first housing 110, and a wire insertion hole 122 is provided in the casing 121. In detail, the casing 121 may be coupled to the housing fastening hole 118 in the first direction A.

The plurality of second housings 120 in which they are coupled to each other, may be coupled to the first housing 110. In detail, the plurality of second housings 120 may include a protrusion rib 123 and rib accommodation portions 124 so that the plurality of second housings 120 can be laterally coupled to each other. For convenience of explanation, it is assumed that the plurality of second housings 120 include a first unit 125 having four wire insertion holes 122 and a second unit 126 having two wire insertion holes 122. As one example, the protrusion rib 123 may be formed at a side of the first unit 125 so as to protrude toward an outer side of the first unit 125, and the rib accommodation portion 124 may be formed at a side of the second unit 126 so as to be coupled to the protrusion rib 123 of the first unit 125 and to be recessed into an inner side of the second unit 126. The protrusion rib 123 and the rib accommodation 124 formed at the first unit 125 and the second unit 126 may be coupled to each other in a sliding manner. In another example, the first unit 125 and the second unit 126 may accommodate a plurality of protrusion ribs and rib accommodation portions. For example, the first unit 125 may include the protrusion rib 123 vertically spaced from the rib accommodation portion 124. The second unit 126 may include another protrusion rib 123 vertically spaced from another rib accommodation portion 124 so as to be respectively coupled to the protrusion rib 123 and the rib accommodation portion 124 of the first unit 125 (see FIG. 16). The number and position of protrusion ribs and rib accommodation portions are not limited to the above examples.

Each of the plurality of second housings 120 may have different numbers of wire insertion holes 122. However, embodiments of the present disclosure are not limited thereto.

The holder unit 127 includes a fixing portion 128 coupled to a top surface of the casing 121, an extension portion 129 that extends from the fixing portion 128 in the first direction A so as to be spaced apart from a top surface of the casing 121 by a predetermined gap, and a protrusion portion 130 that is formed at one end of the extension portion 129 and fastened to the hanging jaw 119. The holder unit 127 is used so that a combination force of the casing 121 with respect to the housing fastening hole 118 can be reinforced.

Each of the connection members 140 and 150 may include a first terminal 140 provided in the first housing 110 so as to electrically connect the FFC 200 and the wires 300 and a second terminal 150 provided in at least one of the second housings 120.

The first terminal 140 and the second terminal 150 may be formed of a material through which a current flows. The material for the first terminal 140 and the second terminal 150 includes a copper alloy.

The first terminal 140 may be provided in the body 111 of the first housing 110 and may include a cable connecting portion 141, a cover holder 142, and a terminal connecting portion 143.

The cable connecting portion 141 may be formed at one end of the first terminal 140 that is in the first direction A, may be fasted to a bottom surface of the accommodation space 117, i.e., the slits 113 formed in the base 112, and may be connected to a lower portion of the FFC 200 inserted into the accommodation space 117.

The cover holder 142 is formed at one end of the first terminal 140 that is in the first direction A so as to be spaced apart from the cable connecting portion 141 by a predetermined gap in a vertical direction. Insertion holes 144 may be formed in a length direction of the cover 114 so as to correspond to the position and number of cover holders 142. The insertion holes 144 prevent rotation of the cover 114 from being limited by the cover holder 142 that fixes the cover 114 at an upper portion of the cover 114. If, in order to insert the FFC 200 into the accommodation space 117, the cover 114 is rotated toward the outer side of the accommodation space 117, the cover holder 142 may be coupled to the insertion holes 144 and may face the cable connecting portion 141.

The number of insertion holes 144 may be larger than or smaller than the number of cover holders 142.

The terminal connecting portion 143 is formed at the other end of the first terminal 140 that extends from the cable connecting portion 141 and the cover holder 142 in the second direction B. In detail, the terminal connecting portion 143 passes through a through hole 145 formed in the body 111 and is exposed into the housing fastening hole 118.

The second terminal 150 may be provided in the casing 121 of the second housing 120 and may include a wire fastening portion 151 and a terminal coupling portion 152.

The wire fastening portion 151 is accommodated in the wire insertion hole 122 so as to be in the second direction B and is electrically connected to the wires 300 inserted into the wire insertion hole 122. The wire fastening portion 151 may have the shape of an arch so as to surround an outer circumferential surface of the wires 300 inserted into the wire insertion hole 122. However, the shape of the wire fastening portion 151 is not limited to the arch shape.

The terminal coupling portion 152 may extend from the wire fastening portion 151 in the first direction A and may include a plurality of fixing pieces 153 through which the terminal coupling portion 152 can be coupled to the terminal connecting portion 143 of the first terminal 140. If the casing 121 of the second housings 120 is inserted into the housing fastening hole 118 of the first housing 110, the terminal connecting portion 143 of the first terminal 140 passes through an opening hole 131 formed in one surface of the casing 121 in the first direction A and is coupled to the terminal coupling portion 152. The terminal connecting portion 143 of the first terminal 140 may be inserted into the terminal coupling portion 152 of the second terminal 150, and the plurality of fixing pieces 153 that face an inner side of the terminal coupling portion 152 may closely contact an outer circumferential surface of the terminal connecting portion 143.

Figure 14:
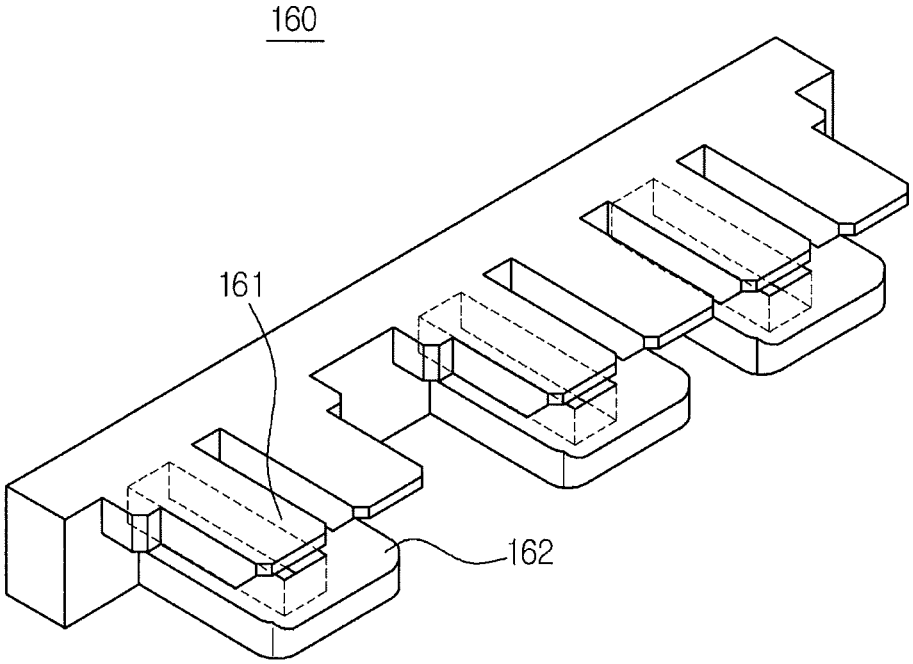
FIG. 14 is a perspective view illustrating a binder that constitutes the connector of FIG. 4.
Figure 15:
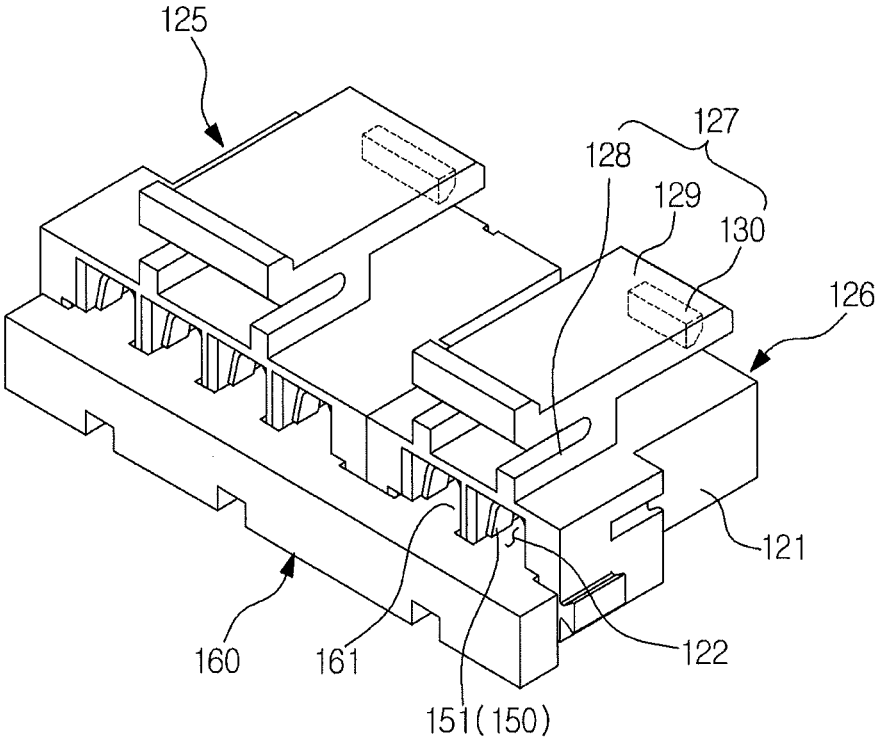
FIG. 15 is a perspective view illustrating a state in which the binder of FIG. 14 is coupled to the second housings.

FIG. 14 is a perspective view illustrating a binder that constitutes the connector of FIG. 4, and FIG. 15 is a perspective view illustrating a state in which the binder of FIG. 14 is coupled to the second housing.

As illustrated in FIGS. 14 and 15, the connector 100 may further include a binder 160. The binder 160 prevents the plurality of second housings 120 coupled to the housing fastening hole 118 from being separated from each other.

The binder 160 may be coupled to the rear of the second housing 120 so as to be in the first direction A.

The binder 160 may include an insertion portion 161 and a support portion 162 that are spaced apart from each other by a predetermined gap in the vertical direction.

The insertion portion 161 may be coupled to the wire insertion hole 122 so as to be placed below the second terminal 150. The support portion 162 may support an outer circumferential surface of a bottom end of the casing 121 if the insertion portion 161 is coupled to the wire insertion hole 122. The insertion portion 161 inside the wire insertion hole 122 may support a bottom end of the wire fastening portion 151.

The binder 160 may have a length corresponding to the number of wire insertion holes 122 formed in the second housing 120, and the insertion portion 161 may have the number corresponding to the number of wire insertion holes 122.

Figure 16:
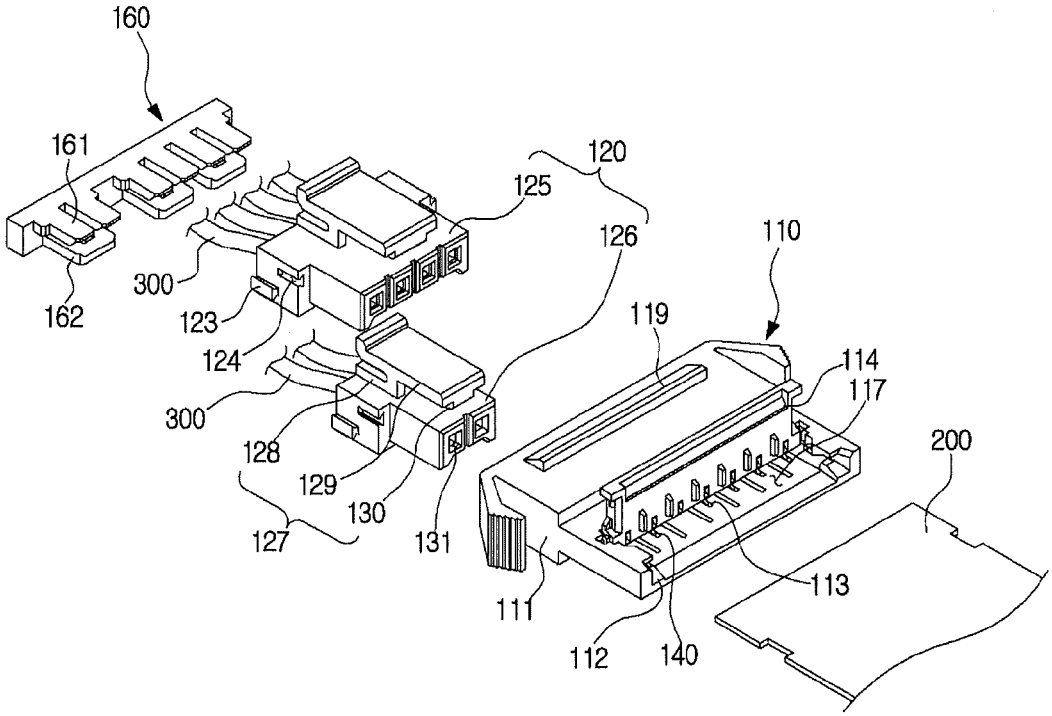
FIG. 16 is a perspective view illustrating an operation of assembling the connector installed at the refrigerator of FIG. 1, in accordance with an embodiment of the present disclosure.

FIG. 16 is a perspective view illustrating an operation of assembling the connector installed at the refrigerator of FIG. 1, in accordance with an embodiment of the present disclosure.

As illustrated in FIG. 16, after the cover 114 is rotated toward the outer side of the accommodation space 117, the FFC 200 is inserted into the accommodation space 117 of the first housing 110 in the second direction B. The wires 300 connected to each electronic component (not shown) are inserted into the wire insertion hole 122 formed in the plurality of second housings 120, and the plurality of second housings 120 are coupled to the housing fastening hole 118 formed in the rear of the first housing 110 in the first direction A in a state in which the second housings 120 are laterally coupled to each other. In this case, the FFC 200 in the accommodation space 117 is coupled to the first terminal 140, and the wires 300 in the wire insertion hole 122 are coupled to the second terminal 150 having one end coupled to the first terminal 140. Thus, the FFC 200 and the wires 300 are electrically connected to each other by the connector 100.

A cover (not shown) that surrounds the FFC 200 and the wires 300 so as to prevent a foaming solution (insulating material) from permeating and the FFC 200 and the wires 300 from being damaged during a foaming operation, may be coupled to the connector 100.

The connector 100 may be used to connect not only the wires 300 and the FFC 200 but also a plurality of FFCs 200.

The connector according to the present disclosure may be used in a kimchi refrigerator or a heating cabinet that is manufactured by foaming and filling an insulating material and a heating material in addition to a refrigerator.

As described above, an FFC is used so that an insulating material can be uniformly foamed between an inner case and an outer case, and thus refrigeration or freezing efficiency can be improved.

A connector including a first housing to which the FFC is coupled, and a plurality of second housings to which a plurality of wires are coupled, is used so that a plurality of cables or wires can be arranged.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

an inner case that constitutes a storage compartment;

an outer case that is coupled to an outer side of the inner case and constitutes an exterior; and a connector that connects a flexible flat cable (FFC) and wires, wherein the connector comprises:

a first housing in which an accommodation space is formed and in which the FFC is inserted;

a plurality of second housings in which a wire insertion hole, into which the wires are inserted, is formed and which are coupled to the first housing; and connection members provided in the first housing and the plurality of second housings so as to electrically connect the FFC and the wires, and wherein the connector is installed at the inner case in such a way that the first housing faces the outer case and the second housings face the storage compartment.

2. The refrigerator of claim 1, wherein a foaming space in which an insulating material is filled is provided between the outer case and the inner case, and the FFC closely contacts an outer surface of the inner case so that the insulating material is capable of being uniformly filled in the foaming space.

3. The refrigerator of claim 1, wherein the first housing comprises:

a body that constitutes an exterior of the first housing;

a base that extends from the body in a first direction and has a plurality of slits formed therein; and a cover that constitutes the accommodation space together with the base and is rotatably coupled to the body.

4. The refrigerator of claim 3, wherein each of the connection members comprises a first terminal provided in the body, and a cable connecting portion is formed at one end of the first terminal, is coupled to the plurality of slits, and is electrically connected to the FFC in the accommodation space.

5. The refrigerator of claim 4, wherein a cover holder is formed at one end of the first terminal so as to be spaced apart from the cable connecting portion by a predetermined gap, and insertion holes are formed in the cover in a length direction of the cover so as to correspond to the cover holder.

6. The refrigerator of claim 5, wherein, if the cover is rotated so that the FFC is inserted into the accommodation space, the cover holder is coupled to the insertion holes and faces the cable connecting portion.

7. The refrigerator of claim 4, wherein a housing fastening hole that is opened in a second direction is formed in the body, and each of the second housings comprises a casing that is coupled to the housing fastening hole and has the wire insertion hole provided in the casing.

8. The refrigerator of claim 7, wherein the other end of the first terminal extends from one end of the first terminal in the second direction so that the first terminal is capable of being accommodated in the housing fastening hole.

9. The refrigerator of claim 8, wherein each of the connection members further comprises a second terminal accommodated in the wire insertion hole, and the second terminal in the wire insertion hole is electrically connected to the other end of the first terminal that passes through the casing.

10. The refrigerator of claim 9, wherein the second terminal comprises:

a wire fastening portion that is accommodated in the wire insertion hole so as to be in the second direction and electrically connected to the wires coupled to the wire insertion hole; and a terminal coupling portion that extends from the wire fastening portion in the first direction so that the other end of the first terminal is capable of being coupled to the terminal coupling portion, and a plurality of fixing pieces are provided at the terminal coupling portion and face an inner side of the terminal coupling portion so as to closely contact an outer circumferential surface of the other end of the first terminal.

11. refrigerator of claim 10, wherein the connector further comprises a binder that is coupled to the second housings in the first direction, and the binder comprises:

an insertion portion that is coupled to the wire insertion hole; and a support portion that is spaced apart from the insertion portion by a predetermined gap in a vertical direction and supports an outer circumferential surface of each of the second housings if the insertion portion is coupled to the wire insertion hole.

12. The refrigerator of claim 11, wherein the insertion portion in the wire insertion hole supports the wire fastening portion.

13. The refrigerator of claim 7, wherein a hanging jaw that protrudes toward an outer side of the body is formed on an outer circumferential surface of the body corresponding to the housing fastening hole, and each of the second housings further comprises a holder unit that is coupled to the hanging jaw so as to reinforce a coupling force of the casing with respect to the housing fastening hole.

14. The refrigerator of claim 13, wherein the holder unit is coupled to the casing, and a protrusion portion is formed at one end of the holder unit in the first direction and is fastened to the hanging jaw.

15. A connector comprising:

a first housing in which an accommodation space is formed and in which a flexible flat cable (FFC) is inserted;

a plurality of second housings in which a wire insertion hole, into which wires are inserted, is formed and which are coupled to the first housing;

connection members provided in the first housing and in the plurality of second housings so as to electrically connect the FFC and the wires; and a binder that is coupled to the wire insertion hole formed in each of the plurality of second housings so as to prevent the plurality of second housings coupled to each other from being separated from each other.

16. The connector of claim 15, wherein the plurality of second housings are laterally coupled to each other, and a protrusion rib is formed at a side of one of the plurality of second housings and protrudes toward an outer side of one of the plurality of second housings, and a rib accommodation portion is formed at a side of another one of the plurality of second housings so as to be coupled to the protrusion rib and to be recessed into an inner side of the another one of the plurality of second housings.

17. The connector of claim 15, wherein each of the connection members comprises:

a first terminal provided in the body that constitutes an exterior of the first housing; and a second terminal that is provided in a casing that constitutes an exterior of the second housings and electrically connected to the first terminal, and the first terminal and the second terminal are formed of a material through which a current flows.

18. The connector of claim 17, wherein the first terminal comprises:

a cable connecting portion that protrudes in a first direction and is electrically connected to the FFC in the accommodation space; and a terminal connecting portion that extends from the cable connecting portion so as to be in a second direction that is different from the first direction.

19. The connector of claim 18, wherein the second terminal comprises:

a wire fastening portion that is accommodated in the wire insertion hole and electrically connected to the wires coupled to the wire insertion hole; and a terminal coupling portion that extends from the wire fastening portion so as to be electrically connected to the terminal connecting portion that passes through the second housings in the wire insertion hole.

20. A connector comprising:

a first housing comprising an accommodation space to insert a flexible flat cable (FFC);

a plurality of second housings comprising wire insertion holes and to couple to the first housing; and a binder coupled to the wire insertion holes to prevent the plurality of second housings from being separated from each other.

* * * * *